United States Patent [19]

Hata et al.

[11] 4,141,291

[45] Feb. 27, 1979

[54] MECHANISM FOR ACTUATING A PLATEN IN A PRINTER

[75] Inventors: Yoshio Hata, Urawa; Hiroyuki Harada, Kawaguchi, both of Japan

[73] Assignee: Copal Company Limited, Tokyo, Japan

[21] Appl. No.: 793,304

[22] Filed: May 3, 1977

[30] Foreign Application Priority Data

May 7, 1976 [JP] Japan ..... 51-51859
May 6, 1976 [JP] Japan ..... 51-56789[U]

[51] Int. Cl.[2] ..... B41J 9/38

[52] U.S. Cl. ..... 101/99; 101/93.42; 101/95

[58] Field of Search ..... 101/93.22, 93.35, 93.36, 101/93.41, 93.42, 95, 96, 99, 110, 287, 288

[56] References Cited

U.S. PATENT DOCUMENTS

| | | | |
|---|---|---|---|
| 2,887,043 | 5/1959 | Ferry | 101/93.36 |
| 3,690,249 | 9/1972 | Nihira | 101/95 |
| 3,789,755 | 2/1974 | Gross | 101/95 |
| 3,861,302 | 1/1975 | Mizutani et al. | 101/99 |
| 3,865,030 | 2/1975 | Chida et al. | 101/93.22 |
| 3,878,777 | 4/1975 | Clary | 101/99 X |
| 3,946,666 | 3/1976 | Yokoyama | 101/99 |

*Primary Examiner*—Edward M. Coven
*Attorney, Agent, or Firm*—J. Harold Nissen

[57] ABSTRACT

A mechanism for actuating a platen of a printer in which a cooperating pin and lever are provided to permit a plurality of printing rings with the desired characters thereon to be printed to be placed into a printing position, to move a platen into abutting engagement with the printing rings and hold them engaged for printing, all during a first period of time, and to remove the platen from the printing rings during a second period of time, and in which the first time period is about two to three times longer than the second time period so that the speed of the printer for each printing operation is increased.

13 Claims, 7 Drawing Figures

MECHANISM FOR ACTUATING A PLATEN IN A PRINTER

BACKGROUND OF THE INVENTION

The present invention relates to a mechanism for actuating a platen in a printer.

More particularly, the invention is concerned with a mechanism for actuating a platen in a printer which is adapted to print a line of printing simultaneously on a paper. The actuating mechanism includes a plurality of rotatable printing rings which are temporarily arrested independently from each other so as to locate selected characters thereon at a printing position which is set in the printer. Also, the platen is abutted against the printing rings, and it is temporarily held or arrested against movement with the paper interposed therebetween to effect a printing onto the paper.

The prior art printer of the type described above is provided with a mechanism for actuating the platen in synchronism with a driving means for rotating the printing rings in order to move the platen towards and away from the printing rings at the same speed so that sufficient time is provided to affect a printing onto the paper. Therefore a delay must be provided to assure that the platen is not positively moved away from the printing rings before effecting a release of the temporary arresting of the printing rings so that the printed paper will not be damaged due to the rotation of the printing rings as a result of a premature releasing thereof.

Further, electromagnets are provided to control the select levers of the printer which in turn controls printing rings with characters thereon. These printing rings must be stopped so as to locate selected characters at the printing position response to the actuation of electromagnets. In order to increase the printing speed, these electromagnets must be deenergized or energized in a very limited or short time period. However, this is not possible with the prior art printer because there are unavoidable time lags, i.e. so-called response time, until the select levers are actually actuated after the magnets are deenergized or energized for the actuation of the select levers. Therefore, the printing speed can not be raised unless the capacity of each magnet is increased or the size of the gears for driving the respective printing rings is made large. In order to raise the speed twice as high as the speed at present, the response time must be reduced to one-fourth of the response time at present which is very difficult to be achieved, and, if the size of the gears is made large, the overall size of the printer is made necessarily large thereby rendering the printer to be less marketable.

The present invention aims at avoiding the above described disadvantages of the prior art printers.

SUMMARY OF THE INVENTION

The object of the present invention is to provide a simple and compact mechanism for actuating a platen in a printer of the type described above and which still insures a very efficient and accurate printing operation.

The above object is achieved in accordance with the characteristic feature of the present invention by providing a mechanism for actuating a platen in a printer having a plurality of rotatable printing rings adapted to be independently arrested temporarily so as to locate a selected character on each printing ring at a printing position set in the printer so that a line of printing is effected simultaneously on a paper by abutting a platen against the printing rings thus temporarily arrested with the paper interposed therebetween, the mechanism being characterized by engaging means for disengageably engaging driving means of the printing rings with coupling means for coupling the platen with the driving means so as to move the platen toward and away from the printing rings and biasing means for urging the coupling means so as to move the platen away from the printing rings, the engaging means being so determined that it engages the coupling means with the driving means during the time the driving means rotates in the range of movement thereof adapted to move the platen toward the printing rings thereby permitting the platen to be abutted against the printing rings in synchronism with the driving means while the coupling means is disengaged from the driving means during the time the driving means rotates in the range of movement thereof adapted to move the platen away from the printing rings thereby permitting the platen to be moved away quickly from the printing rings by the action of the biasing means out of synchronism with the driving means.

By the construction of the printer of the present invention as described above, sufficient time is available in arresting the printing rings for selection of the characters in each printing cycle, while the platen is instantaneously moved apart from the printing rings after the printing operation so that the danger is positively avoided that the printed paper might be damaged due to the premature releasing of the arrested printing rings.

DETAILED DESCRIPTION OF THE PREFERRED EMBODIMENTS

First, the general construction and operation of a printer incorporating the present invention will be briefly described with reference to FIG. 1.

Figure 1:
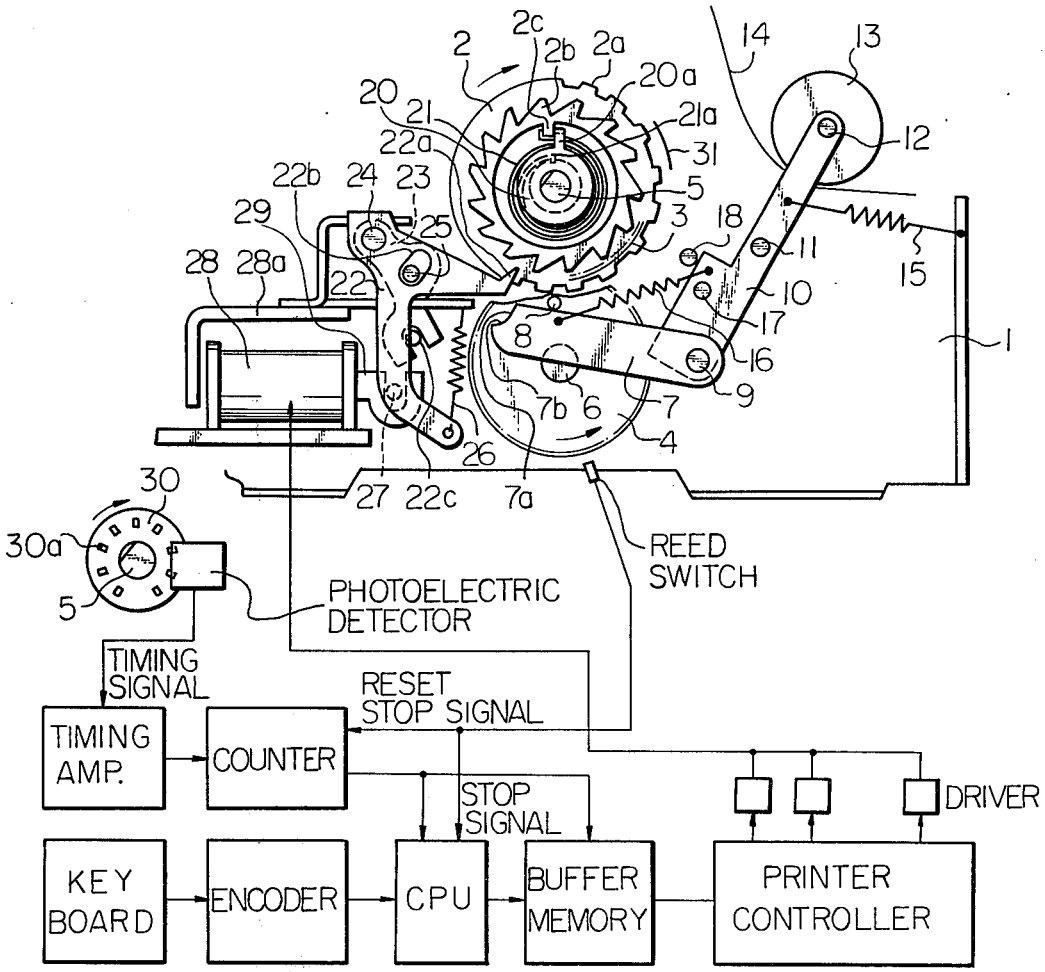
FIG. 1 is a schematic side view showing the main portions of the printer incorporating the mechanism for actuating the platen thereof constructed in accordance with the present invention.

The printer shown in FIG. 1 comprises a frame 1, driving means comprised of a driving gear 4 rotatably supported by a shaft 6 secured to the frame 1, a driving shaft 5 rotatably supported in the frame 1 and a driven gear 3 securely mounted on shaft 5. The driven gear 3 meshes with the gear 4. The gear 4 is rotated by one revolution in the counterclockwise direction by an electric motor (not shown) upon issuance of a printing command from a control circuit to be described later, so that the gear 3 and, hence, the driving shaft 5 is rotated by one revolution in the clockwise direction each time the printing command is issued.

A plurality of printing rings 2 are rotatably mounted in juxtaposed relationship adjacent to each other on the driving shaft 5. Each of the printing rings 2 bears on the periphery thereof a plurality of printing characters 2*a* and is provided with a ratchet 2*b* having teeth corresponding to the respective characters 2*a* and integrally formed therewith and a stopper 2*c*is formed in the recess formed concentrically in the ratchet 2*b*.

A spiral spring 21 is provided around the shaft 5 for each of the printing rings 2. One end of the spring 21 is supported by the stopper 2*c* of each printing ring 2 while the other end is secured to a stopper 20*a* on a retaining washer 20. Each printing ring 2 is provided with the stopper 20*a* so that each printing ring 2 is angularly urged by the spring 21 in the clockwise direction until the stopper 2*c* of the printing ring 2 abuts against the stopper 20*a* of the washer 20 and so that each printing ring 2 is held at the starting position for the printing characters 2*a* with respect to the driving shaft 5. Each printing ring 2 is, therefore, permitted to be temporarily arrested so as to locate a selected character 2*a* thereof at a printing position set in the printer while the shaft 5 rotates. Rotation of shaft 5 energizes the spring 21 when the ratchet 2*b* is engaged by the respective select lever 22 to be described later upon issuance of the printing command so as to effect a printing operation on a paper 14 in cooperation with a platen 13 to be described later. Platen 13 is also actuated in synchronism with the driving means by the printing command so as to abut against the printing rings 2 which are temporarily arrested at the printing position with the paper 14 held therebetween together with the inking ribbon 31. The inking ribbon 31 may be replaced by an ink roller adapted to supply ink on the periphery of each printing ring 2 after the platen 13 is moved apart from the printing rings 2 upon completion of the printing operation on the paper 14 and the respective printing rings 2 are released from the select levers 22 and return to their starting position by the action of the springs 21.

Each of the select levers 22 is swingably supported by a shaft 24 secured to the frame 1 or a magnet frame 28*a*. An arresting claw 22*a* extending from the select lever 22 is arranged adjacent to the respective ratchet 2*b* for cooperation therewith while a downwardly extending arm of each lever 22 is connected to one end of a spring 26 having the other end connected to the magnet frame 28*a* so that each lever 22 is urged in the counterclockwise direction so as to cause the claw 22*a* to engage with the ratchet 2*b*. The armature 29 of each electromagnet 28 for the respective printing ring 2 is pivotably connected by a pin 27 to the respective select lever 22. Each electromagnet 28 is normally energized during the operation of the printer so that the respective select lever 22 is urged in the clockwise direction by the electromagnet 28 against the action of the spring 26 so as to maintain the claw 22*a* disengaged from the ratchet 2*b* to permit the free rotation of the printing ring 2, and, upon issuance of the printing command, the respective electromagnet 28 is deenergized independently from each other at the appropriate time by the operation of the control circuit for selection of the characters so that the respective select lever 22 is selectively swung in the counterclockwise direction by the action of the spring 26 so as to engage the claw 22*a* with the ratchet 2*b* thereby temporarily arresting the printing ring 2 and locating selected character 2*a* thereof at the printing position.

After the platen 13 has abutted against the printing rings 2 for the printing operation and moved away therefrom, each select lever 22 is swung simultaneously in the clockwise direction so as to release the claw 22*a* from the ratchet 2*b* so that each printing ring 2 is returned to its starting position by the action of the spring 21 thus far energized during the temporary arresting of the printing ring 2 while the shaft 5 is rotating. To this end, a pin 25 engaging in elongated hole 22*b* of each select lever 22 and actuated in synchronism with the driving shaft 5 is moved in the clockwise direction about the shaft 24 so that the select levers 22 are simultaneously swung in the clockwise direction against the action of the springs 26 to release the claws 22*a* from the ratchets 2*b*, at which time the electromagnets 28 are already energized thereby permitting the select levers 22 to be held in released positions. Thus, the printing rings are returned in their starting positions so as to be ready for the next printing operation. Instead of deenergizing the electromagnets 28, they may be energized for arresting the printing rings 2.

The control circuit for operating the printer comprises a key board, a key encoder, a CPU, an output buffer memory, a printer controller, a timing amplifier, a counter and driver transistors connected as shown in FIG. 1.

The timing amplifier receives timing signal issued from a photoelectric detector adapted to sense light passing through slits 30*a* of a timing disc 30 rotated together with the driving shaft 5 so as to issue the timing signal corresponding to the timing of each character passing through the printing position. The counter receiving the timing signal also receives a reset stop signal from a reed switch cooperating with a ferromagnetic piece on the driving means so as to seek the home position or starting position of the operation of the printer to reset the counter and apply a stop signal to CPU in each printing operation.

Upon manipulation of the key board, the encoder usually comprising a diode matrix encodes the input from the key board and applies the output thereof to the CPU for the operation thereof with the output of the counter being an input to the CPU. The buffer memory receiving the output of the CPU and the counter stores the data for the printing maintaining the timed relationship to the actuation of the mechanical elements of the printer. The printer controller receiving the data from the buffer memory converts the data into printer driving signals which are supplied through the driver transistors to the motor for driving the printing rings 2 and the platen and the respective electromagnets 28 actuating the select lever 22 for selection of the characters in timed relationship to the rotation of the printing rings 2.

The operation of the control circuit per se is not the subject matter of the present invention, and, therefore, detailed description thereof is omitted.

Before the characteristic feature of the present invention is described, an example of the prior art mechanism for actuating the platen of a printer will be described with reference to FIG. 2.

Figure 2:
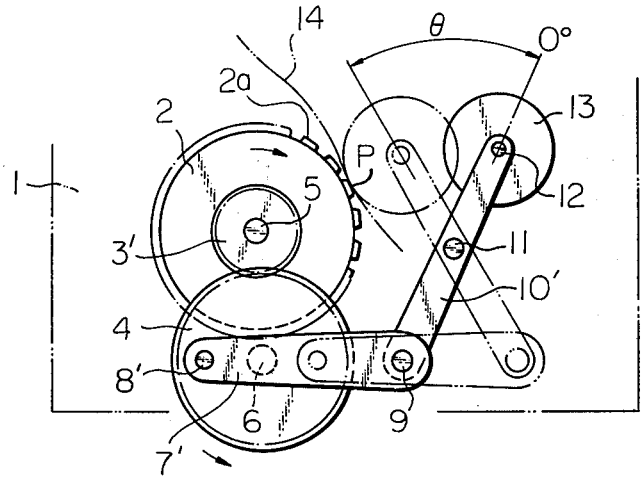
FIG. 2 is a schematic fragmentary side view showing an example of a platen actuating mechanism incorporated in a prior art printer.

In FIG. 2, the prior art mechanism for actuating the platen 13 comprises the driving gear 4 adapted to be driven about the shaft 6 by the motor (not shown), a driven gear 3' secured to the driven shaft 5 for the printing rings 2 so that the shaft 5 is rotated two revolutions in the clockwise direction each time the driving gear 4 rotates one revolution. The printing rings 2 are yieldably rotated by the shaft 5 as previously described.

The platen 13 is rotatably supported by a pin 12 at one end of a swingable lever 10' the intermediate portion of which is swingably supported by a shaft 11 to the frame 1. The other end of the swingable lever 10' is pivotally connected by a pin 9 to one end of a pivotable lever or a crank lever 7' the other end of which is pivotally supported by a crank pin 8' secured to the driving gear 4 as shown in FIG. 2.

In operation, when the driving gear 4 is rotated upon issuance of a printing command, the driven shaft 5 is rotated one revolution during a first half revolution of the gear 4 within which the printing rings 2 are temporarily and selectively arrested by the select levers for the selection of selected characters as described previously. At the same time, the swingable lever 10' is swung in the counterclockwise direction by the pivotable lever 7' actuated by the pin 8' while the driving gear 4 rotates the first half revolution starting at the position shown in FIG. 2 so that the platen 13 is moved to abut against the printing rings 2 at the printing position P which rings 2 have been already arrested for locating the selected characters at the printing position, thereby permitting one line of the printing to be effected on the paper 14 sandwiched between the printing rings 2 and the platen 13.

After the printing is completed, the platen 13 is moved away from the printing rings 2 during the second half revolution of the driving gear 4 while the printing rings 2 are released from the select levers to return to their starting positions and the paper 14 is fed by feeding means (not shown) so as to be ready for the next operation.

Figure 3:
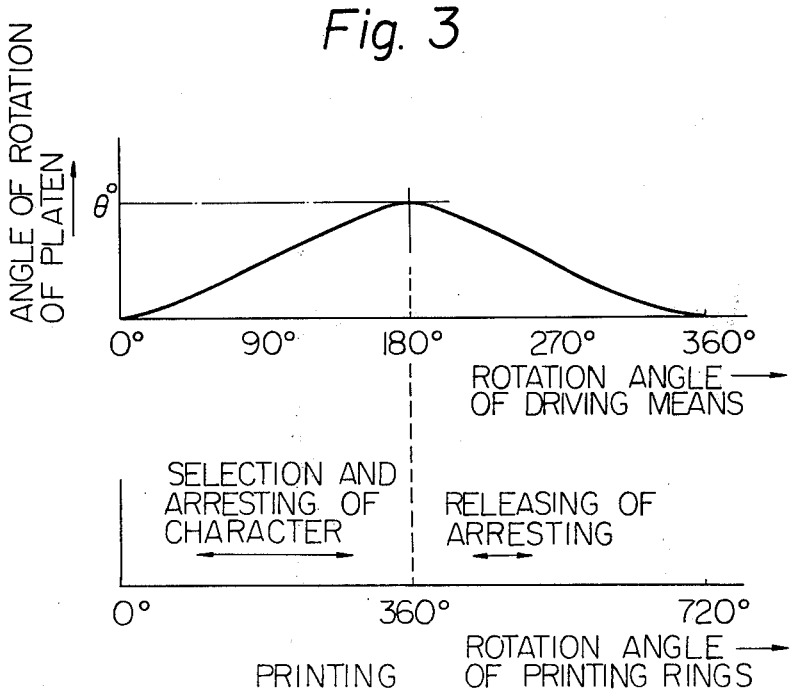
FIG. 3 is a diagram showing the relationship between the angle of rotation of the platen and the rotation angle of the driving means for driving the driving shaft of the printing rings shown in FIG. 2 to which the manner of arresting and releasing of the printing rings is referred.

By the prior art printer as described above, since the platen 13 is actuated by the reciprocating movement of the crank mechanism comprising the pin 8' and the lever 7', the moving velocity of the platen 13 is the same both in the forward, i.e., approaching and the backward, i.e., returning movement thereof relative to the printing rings 2 as shown in FIG. 3. Therefore, the releasing signal for the select levers might be applied to the magnets before the platen 13 is moved away from the printing rings 2 because of the slow speed of the returning movement of the platen 13 so that the printed paper 14 might be damaged, while the printing speed can not be raised as previously described.

The characteristic feature of the present invention lies in that the above disadvantages of the prior art printer are positively avoided by the provision of disengageably engaging means interposed between the crank pin of the driving gear 4 and the pivotable lever pivoted to the swingable lever mounting thereon the platen 13 and the biasing means for urging the platen away from the printing rings 2 as described hereinbelow with reference to FIGS. 4 to 7.

Figure 4:
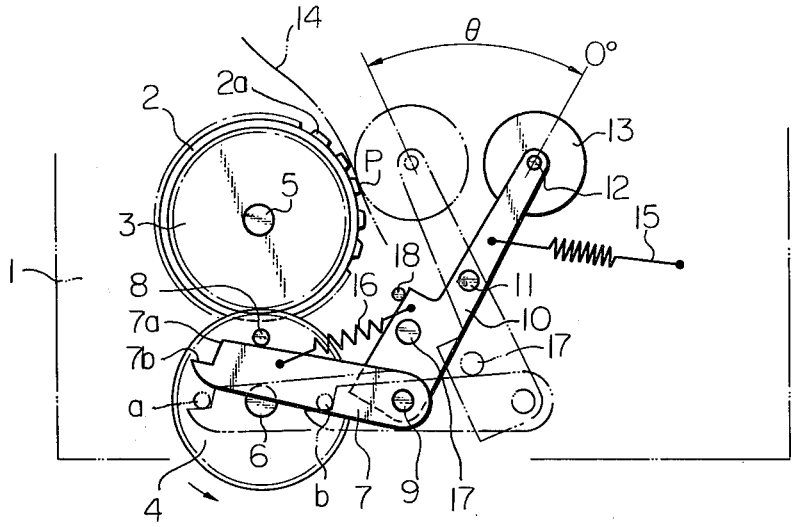
FIG. 4 is a schematic side view similar to FIG. 2 but showing a first embodiment of the present invention.

Referring now to FIG. 4 showing the first embodiment of the present invention, the general construction is substantially similar to that shown in FIG. 2 except that the pivotable lever 7 is formed with engaging surfaces *7a, 7b* at its end opposite to that pivoted to the swingable lever 10 by the pin 9 for cooperation with the pin 8 and a spring 16 is connected between the lever 7 and the lever 10 so as to urge the lever 7 in the clockwise direction but such movement is limited by a stopper 17 provided on the lever 10 as shown by chain line in FIG. 4, while a spring 15 is connected to the swingable lever 10 so as to urge the platen 13 away from the printing rings 2 but the movement of the lever 10 is limited by a stopper 18 and the gear ratio between the gears 4 and 3 is set 1:1 so that the driven shaft 5 is rotated one revolution each time the gear 4 rotates one revolution.

In operation upon input of a printing command, the gear 4 rotates in the counterclockwise direction together with the pin 8 starting at the positions indicated by solid line in FIG. 4.

Thus, the pivotable lever 7 is urged in the counterclockwise direction against the action of the spring 16 by the pin 8 sliding along the upper edge of the lever 8 and, when the pin 8 reaches the position a indicated by the chain line, the pin 8 engages with the engaging surfaces *7a, 7b* so that the pivotable lever 7 is urged toward the right in FIG. 4 as the gear 4 rotates together with the pin 8 by a first half revolution starting at the position a of the pin 8 thereby swinging the swingable lever 10 in the counterclockwise direction against the action of the spring 15 so as to abut the platen 13 against the printing rings 2 at the printing position P. At this position, the stopper 17 abuts against the pivotable lever 7 so as to prevent the clockwise rotation of the lever 7 from the position as indicated by the chain line in FIG. 4. Until such time as the platen 13 abuts against the printing rings 2, the shaft 5 rotates half a revolution within which the printing rings 2 have been arrested for locating the selected characters at the printing position P as previously described, so that one line of printing is effected on the paper 14.

After the printing operation has been completed, the gear 4 rotates a second half counterclockwise revolution starting at the position b of the pin 8 so that the pin 8 is disengaged from the engaging surfaces *7a, 7b,* because the lever 7 is limited its clockwise rotation by the stopper 17. Thus, the lever 7 is released, and the swingable lever 10 is quickly swung in the clockwise direction by the action of the spring 15 to move the platen 13 away from the printing rings 2 so as to assume the positions shown by solid line in FIG. 4. During the second half revolution of the shaft 5, the printing rings 2 are released to return to their starting positions and the paper 14 is fed in the manner as previously described.

Figure 5:
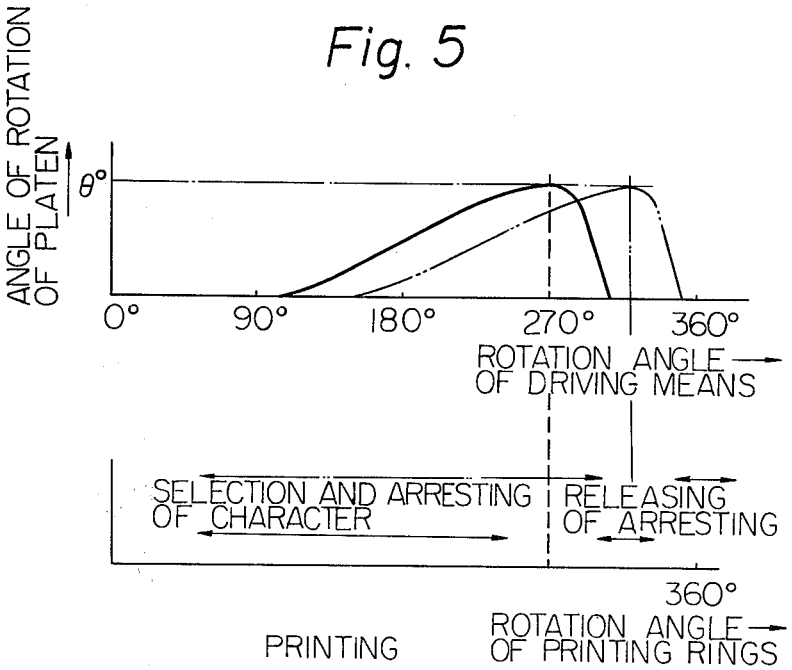
FIG. 5 is a diagram similar to FIG. 3 but showing the relationship between the angle of rotation of the platen and the rotation angle of the driving means shown in FIG. 4 to which the manner of arresting and releasing of the printing rings is referred

FIG. 5 shows the relationship of the movement of the platen and the printing rings. Thus, the range of rotation of the shaft 5 in which the selection of the characters is effected can be broadened to about 270° or more to insure accurate operation of the printer.

The starting position of the pin 8 may be varied depending upon the number of the characters, for example, as shown in two-dot chain line in FIG. 5.

In the embodiment shown in FIG. 4, the pin 8 may be secured to driven gear 3. In this case, the rotation of the gear 3 is changed to the reverse direction. The motor may be directly coupled with the driven gear 3.

Further, the crank mechanism comprising the pin 8 and the lever 7 may be replaced by a cam integral with the driving gear 4 so that the cam directly actuates the swingable lever 10.

Further, the platen 13 may be reciprocally moved tangentially to the periphery of each printing ring 2 so that the platen 13 contacts at the printing portion P with the printing rings 2. To this end, a spring is provided connected to the member supporting the platen so that it is energized during the time the platen is moved to contact with the printing rings while the platen is moved away from the printing rings by the action of the spring thus energized during the movement of the platen toward the printing rings. Such modifications may also be applicable to the embodiments described later.

The embodiment shown in FIG. 4 makes it possible to operate the printer at a speed twice as high as that of the prior art printer shown in FIG. 2, while accurate operation is insured.

Figure 6:
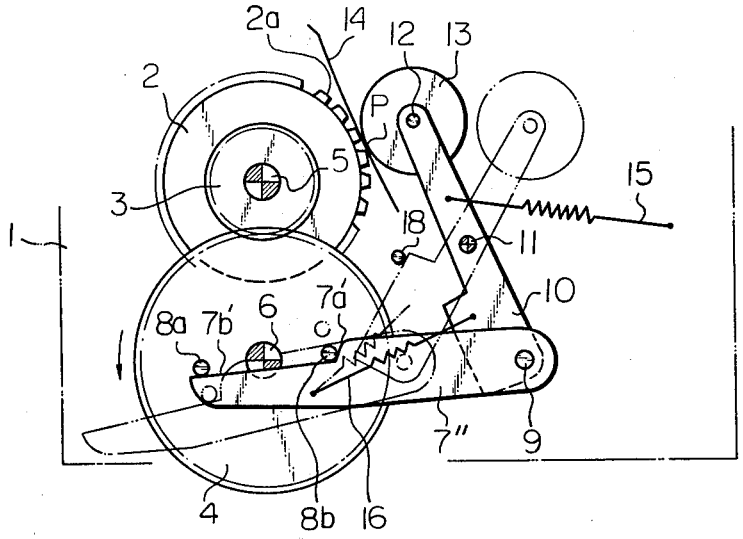
FIG. 6 is a schematic side view similar to FIG. 4 but showing a second embodiment of the present invention.

FIG. 6 shows a second embodiment of the present invention. This embodiment is substantially similar to that shown in FIG. 4 except that a pair of diametrically oppositely arranged pins 8*a*, 8*b* are secured to the driving gear 4, while the gear ratio between the driving gear 4 and the driven gear 5 is so set that the shaft 5 is rotated one revolution each time the gear 4 rotates half a revolution so that the platen 13 is abutted once against the printing rings 2 by half a revolution of the gear 4 by virtue of the provision of two diametrically oppositely arranged pins 8*a*, 8*b* cooperating with the pivotable lever 7″, while the printing rings 2 are once arrested for location of selected characters at the printing position P and released to return to their starting positions during each half revolution of the driving gear 4 thereby permitting the printing operation to be effected once during each half revolution of the driving gear 4 for completing one cycle of the printing operation.

To this end, the engaging surface 7*a*′ is positioned at an appropriate distance from the tip of the pivotable lever 7″.

In operation, when the driving gear 4 rotates in the counterclockwise direction upon input of a printing command starting at the positions shown by the solid line in FIG. 6 wherein the pin 8*a* just reaches the engaging surface 7*b*′ of the pivotable lever 7″ while the pin 8*b* is in engagement with the engaging surface 7*a*′ thus holding the pivotable lever 7″ in the position shown by the solid line to maintain the platen 13 abutting against the printing rings 2, the pin 8*a* urges the lever 7″ in the counterclockwise direction so that the pin 8*b* is disengaged from the engaging surface 7*a*′ so that the pivotable lever 7″ is freed thereby permitting the swingable lever 10 to be swung quickly in the clockwise direction by the action of the spring 15 to move the platen 13 away from the printing rings 2 as shown by the chain line in FIG. 4. As the gear 4 continues to rotate, the pin 8*a* slides along the engaging surface 7*b*′ and engages with the engaging surface 7*a*′ as shown by the chain line in FIG. 6, so that the lever 7″ is urged toward the right in the figure to swing the swingable lever 10 in the counterclockwise direction against the action of the spring 15 so as to abut the platen 13 against the printing rings 2 at the same time, the printing rings are arrested for location of the selected characters at the printing position P after the platen 13 has been quickly moved away from the printing rings 2 in the manner as described previously, thereby effecting the printing operation.

This operation is terminated at the end of half a revolution of the driving gear 4 to resume the positions shown by the solid line in FIG. 6 with the pins 8*a*, 8*b* being replaced by each other.

The succeeding printing operation is commenced by the second half rotation of the driving gear 4 upon input of a printing command, and the operation is repeated.

In the embodiment shown in FIG. 6, since the speed of the driving gear 4 is reduced to ½ in comparison with that of the gear 4 in FIG. 4 without lowering the printing speed, the pressing force of the platen 13 against the printing rings 2 is raised thereby insuring the appropriate density of the printed characters on the paper.

Figure 7:
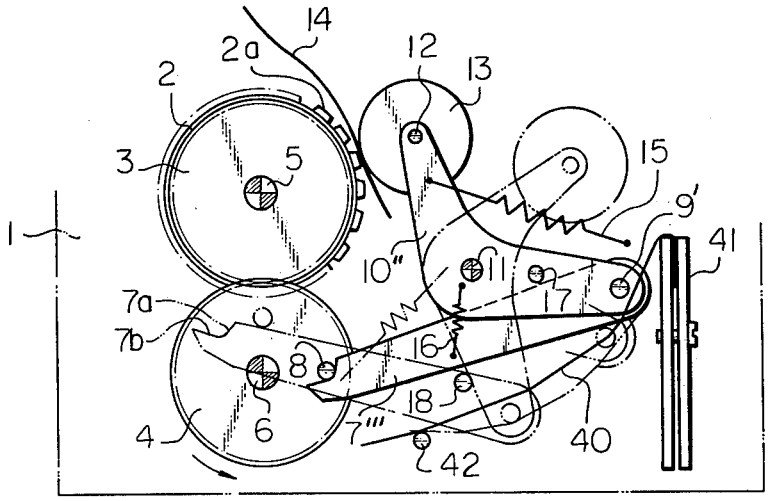
FIG. 7 is a schematic side view similar to FIG. 4 but showing a third embodiment of the present invention.

FIG. 7 shows a third embodiment of the present invention. The construction and operation of the embodiment shown in FIG. 7 is substantially similar to those shown in FIG. 4 although the configuration of the swingable lever 10″ and the size of the lever 7‴ are modified from the swingable lever 10 and the lever 7 of FIG. 4.

The only difference in the embodiment of FIG. 7 which distinguishes it from the embodiment of FIG. 4 is that the pin 9′ connecting the levers 7‴ and 10″ is elongated to extend from the lever 10″ and the lever 7‴ and a leaf spring 40 is arranged so that at least a portion thereof is located in the path of movement of the pin 9′ so as to effect a buffering effect on the quick returning movement of the lever 10″ by the action of the spring 15 which might cause a shortening of the service life of the printer. The buffering effect of the leaf spring 40 is also effective to absorb noise due to the shock.

The spring 40 is supported at its one end by a support member 41 secured to the frame 1 while the free end is supported by a stationary pin 42. The intermediate portion of the spring 40 is located in the path of movement of the pin 9′ and is can be resiliently flexed by the sliding contact with the pin 9′ when the same is moved as the lever 10″ is quickly swung by the action of the spring 15 thereby absorbing the kinetic energy of the lever 10″ and retarding the movement of the lever 10″ until the lever 10″ is stopped by the stopper 18.

The above described buffering action may also be applied to the embodiment shown in FIG. 6.

We claim:

1. Mechanism for actuating a platen in a printer having a plurality of printing rings independently rotatably and coaxially mounted on a driving shaft in juxtaposed relationship adjacent to each other, a stopper, each of said printing rings having a plurality of printing characters on its periphery and urged by a printing ring spring so as to be held by said stopper at a predetermined angular starting position thereof for said printing characters with respect to said driving shaft, coupling means coupling said platen with said driving shaft so as to move said platen into abutment with and away from said printing rings, driving means for rotating said driving shaft responsive to receipt of a printing command from a control circuit of said printer, arresting means for temporarily arresting each of said printing rings independently from each other against the action of said printing ring spring so as to locate a selected printing character in the respective ring at a predetermined printing position in said printer while said driving shaft is rotated so that each printing ring leaves its starting position and is moved into a printing position and is temporarily held thereat for printing in response to said printing command, the actuation of said coupling means being so interrelated in synchronism with that of said arresting means and said printing command that said platen abuts against said printing rings after having been temporarily arrested for locating said selected character in each printing ring at said printing position thereby permitting printing of said selected characters to be effected on a paper interposed between said printing rings and said platen to form a line of printing simultaneously on said paper and said platen is moved away from said printing rings before release thereof from said arresting means and, thereafter, said driving means is de-energized by said printing command to stop said driving shaft and complete one cycle of printing operation by said printing command, wherein the improvement comprises:

means engaging said driving means with said coupling means;

biasing means on said coupling means urging said platen away from said printing rings; and cooperating means on said engaging means and said driving means for operatively associating said coupling means with said driving means during a first period that said driving means rotates to move said platen towards said printing rings and said platen abuts said printing rings in synchronism with said driving means, and said cooperating means comprising disassociating means on said engaging means operatively associated with said driving means but operatively disassociating said coupling means from said driving means to permit said biasing means to move said platen out of engagement with said printing rings during a second period of said driving means to separate said platen from said printing rings.

2. Mechanism according to claim 1, wherein:

said coupling means comprises a swingable lever having a first end pivotally connected with said platen and a second end, said engaging means comprising a pivotable lever having one end pivotally connected with said second end and having a second end forming part of said cooperating means, said cooperating means comprising an engaging shoulder at the other end of said pivotable lever and a pin on said driving means rotatable by said driving means in an arcuate path in synchronism therewith, and said disassociating means including an intermediate portion on said pivotable lever proximate to said other end cooperating with said pin to pivot said swingable lever about said second end;

said biasing means comprising a spring connected with said swingable lever urging said platen out of engagement with said printing rings;

said pin and said shoulder being engageable during the time said pin rotates in an arcuate path to move said platen towards said printing rings thereby permitting said swingable lever to be swung so as to abut said platen against said printing rings, and said pin and said shoulder being disengaged during the time said pin rotates in said arcuate path to move said platen away from said printing rings whereby to permit said spring to rapidly move said swingable lever and thereby said platen out of engagement with said printing rings.

3. Mechanism according to claim 2 further comprising:

a spring connecting said pivotable lever to said swingable lever to urge said levers together and said pivotable lever against said pin, and a stopper on said swingable lever, said stopper being positioned to arrest said pivotable lever when said levers are urged together by said spring and said pin comes to the end of its movement in its arcuate path to move said platen toward said printing rings and further movement of said driving means thereby disengaging said engaging shoulder of said pivotable lever from said pin.

4. Mechanism according to claim 1, including:

means to set the driving ratio of said driving means to rotate said driving shaft two revolutions for each revolution of said driving means; and said cooperating means includes dual means for operatively associating said coupling means with said driving means so that temporary arresting and releasing of said printing rings are effected twice in one revolution of said driving means, and, said platen is twice abutted against said printing rings in one revolution of said driving means, thereby permitting the printing operation to be effected two times for each revolution of said driving means.

5. Mechanism according to claim 4, wherein:

said coupling means comprises a swingable lever having a first and a second end, said platen being mounted at said first end, said engaging means comprises a pivotable lever having one end pivoted to said second end, said cooperating means including an engaging shoulder at the intermediate portion of said pivotable lever and a pair of pins on said driving means cooperating with said engaging shoulder and diametrically oppositely arranged symmetrically with respect to the axis of said driving means for rotation together therewith and, said biasing means comprises a spring connected to said swingable lever to urge said platen away from said printing rings, each of said pins engaging with said engaging shoulder during the time the respective pin is rotated in an arcuate path by said driving means thereby permitting said swingable lever to swing said platen towards and against said printing rings twice during each revolution of said driving means, and while the respective pin is disengaged from said engaging shoulder during the time the respective pin is disengaged from said engaging shoulder during the time the respective pin rotates in the arcuate path, said spring urges said swingable lever to swing quickly away from said printing rings and move said platen away from said printing rings.

6. Mechanism according to claim 5, further comprising:

a spring connecting said pivotable lever to said swingable lever to urge said pivotable lever against said pins, and a stopper on said swingable lever, said stopper being positioned to arrest said pivotable lever when one of said pins comes to the end of its movement in its arcuate path to move said platen toward said printing rings thereby disengaging said engaging shoulder of said pivotable lever from said one of said pins.

7. Mechanism according to claim 1, further comprising:

buffer means for retarding the quick returning of said coupling means by said biasing means, said buffer means comprising:

a support, and a leaf spring having one end fixedly secured and its other end free and supported by said support, said leaf spring having an intermediate portion extending into the path of movement of said coupling means for resilient contact therewith so that the quick returning of said coupling means is retarded.

8. In a mechanism for actuating a platen of a printer having a plurality of independent printing rings, a driving gear mechanism for rotating said printing rings to bring them with the preselected characters thereon to be printed into a printing position and holding them thereat during a first phase and moving said printing rings out of the printing position during a second phase, coupling means coupling said printing rings with said platen to move said platen during said first phase into abutting relationship and the printing position with said printing rings and to move said platen during said second phase away from said printing rings and out of the printing position, including a pivotable lever having one end associated with said driving gear, a swingable lever having one end rotatably supporting said platen and its other end pivotally connected with the other end of said pivotable lever, the improvement comprising:

cooperating means on said driving gear and said pivotable lever to control the duration of said first and said second phases so that the duration of said first phase is larger than the duration of said second phase, said cooperating means including:

a crank pin on said driving gear, and crank pin engaging surfaces on said one end of said pivotable lever;

said crank pin being engageable with said engaging surfaces to move said swingable lever to move said platen into engagement with said printing rings and hold them in abutting relationship during the first phase and to separate them during said second phase.

9. In a mechanism as claimed in claim 8, including a stopper on said swingable lever to limit the amount of movement of said crank lever toward said swingable lever.

10. In a mechanism as claimed in claim 8, including a spring connecting said swingable lever relative to said printer to urge said swingable lever in a direction to move said platen out of abutting relationship with said printing rings, and a stopper associated with said printer to limit the amount of movement of said swingable lever under the urging of said spring.

11. In the mechanism as claimed in claim 8, wherein said cooperating means includes:

a pair of diametrically oppositely arranged pins on said driving gear, and a pair of engaging surfaces on said pivotable lever, one of said engageable surfaces being at said one end of said pivotable lever and the other of said engaging surfaces being intermediate the ends of said pivotable lever, said intermediate engageable surface being engageable with one of said pins to hold said platen in engagement with said printing rings, and said other of said pins being engageable with the engageable surface at the end of said pivotable lever to move said platen out of engagement with said printing rings.

12. In the mechanism as claimed in claim 8, including:

a spring connected between said pivotable lever and said swingable lever to urge said crank lever in a direction towards said swingable lever, said pivotable lever having another surface engageable with said crank pin to permit said platen to remain out of abutting relationship with said printing rings, during said second phase.

13. Mechanism for actuating a platen in a printer having a plurality of printing rings independently rotatably and coaxially mounted on a driving shaft in juxtaposed relationship adjacent to each other, a stopper, each of said printing rings having a plurality of printing characters on its periphery and urged by a printing ring spring so as to be held by said stopper at a predetermined angular starting position thereof for said printing characters with respect to said driving shaft, a platen, coupling means coupling said platen with said driving shaft so as to move said platen into abutment with and away from said printing rings, driving means for rotating said driving shaft respective to the receipt of a printing command from a control circuit of said printer, arresting means for temporarily arresting each of said printing rings inedependently from each other against the action of said printing ring spring so as to locate a selected printing character in the respective printing ring at a predetermined printing position in said printer while said driving shaft is rotated so that each printing ring leaves its starting position and is moved into a printing position and is temporarily held thereat for printing in response to said printing command, the actuation of said coupling means being so interrelated in synchronism with that of said arresting means and said printing command that said platen abuts against said printing rings after having been temporarily arrested for locating said selected character in each printing ring at said printing position thereby permitting printing of said selected characters to be effected on a paper interposed between said printing rings and said platen to form a line of printing simultaneously on said paper and said platen is moved away from said printing rings before release thereof from said arresting means and, thereafter, said driving means is de-energized by said printing command to stop said driving shaft and complete one cycle of printing operation by said printing command, wherein the improvement comprises:

means comprising a pivotable lever engaging said driving means with said coupling means, said pivotable lever comprising a first end having an engaging shoulder and a second end;

said coupling means comprising a swingable lever having a first end pivotally connected with said second end of said pivotable lever and a second end connected with said platen;

said driving means including a pin thereon rotatable in synchronism therewith, said pin being engageable with and cooperating with said engageable shoulder; and, biasing means comprising a spring connected to said swingable lever for urging thereof and said platen away from said printing rings;

said pin engaging with said engaging shoulder during the time said pin rotates in an arcuate path to move said platen towards said printing rings by swinging said swingable lever and said platen against said printing rings, and said spring moving said platen away from said printing rings, said pin is disengaged from said engaging shoulder during the time said pin rotates in an arcuate path to move said platen away from said printing rings, said spring being rendered operative to quickly move said platen away from said printing rings.

* * * * *